US007653488B2

(12) United States Patent
Mese et al.

(10) Patent No.: US 7,653,488 B2
(45) Date of Patent: Jan. 26, 2010

(54) DETERMINATION OF POINT OF SAND PRODUCTION INITIATION IN WELLBORES USING RESIDUAL DEFORMATION CHARACTERISTICS AND REAL TIME MONITORING OF SAND PRODUCTION

(75) Inventors: Ali I. Mese, Houston, TX (US); Colin Michael Sayers, Katy, TX (US); Robert Andrew Holicek, Katy, TX (US); Dan Shan, Houston, TX (US); Donald W. Lee, Houston, TX (US); Jorge Aurelio Santa Cruz Pastor, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 18 days.

(21) Appl. No.: 11/844,251

(22) Filed: Aug. 23, 2007

(65) Prior Publication Data

US 2009/0055098 A1 Feb. 26, 2009

(51) Int. Cl.
*G01V 9/02* (2006.01)

(52) U.S. Cl. ..... 702/6; 702/11; 702/12; 702/50

(58) Field of Classification Search ..... 702/3, 702/4, 6, 11, 12, 14, 32, 188; 73/152.17, 73/152.59; 166/245; 219/538; 703/9
See application file for complete search history.

(56) References Cited

U.S. PATENT DOCUMENTS 5,353,637 A * 10/1994 Plumb et al. ..... 73/152.17
5,517,854 A * 5/1996 Plumb et al. ..... 73/152.59
5,965,810 A * 10/1999 Holbrook ..... 73/152.05
6,782,947 B2 * 8/2004 de Rouffignac et al. ..... 166/245

OTHER PUBLICATIONS

Acock et al., "Practical Approaches to Sand Management", Oilfield Review, Spring 2004, pp. 11-27.
Weissenburger et al., "The Engineering Approach to Sand Production Prediction", 1987, Society of Petroleum Engineers, pp. 151-158.
Morita et al., "Realistic Sand-Production Prediction: Numerical Approach", SPE Production Engineering, Feb. 1989, pp. 15-24.
Morita et al., "Parametric Study of Sand-Production Prediction: Analytical Approach", SPE Production Engineering, Feb. 1989, pp. 25-33.
Morita et al., "Fracturing, Frac Packing, and Formation Failure Control: Can Screenless Completions Prevent Sand Production?", SPE Drilling & Completion, Sep. 1998, pp. 157-162.
Fuh et al., "Use of Borehole Stability Analysis for Successful Drilling of High-Angle Hole", 1988, IADC/SPE Drilling Conference, Dallas, TXpp. 483-491.

(Continued)

*Primary Examiner*—Eliseo Ramos Feliciano
*Assistant Examiner*—Felix E Suarez

(57) ABSTRACT

Predicting sand production in a wellbore. A first set of characteristics is determined for a formation in the wellbore, wherein determining uses a plastic model of the formation, and wherein the first set of characteristics comprises a yield surface, a failure surface, a stress total strain, an elastic strain, and a plastic-strain relationship. A relationship among a second set of characteristics of the wellbore is determined using an effective stress model, wherein the second set comprises a drawdown pressure, a production rate, pore pressure, a temperature and a viscosity of a fluid in the wellbore, a fluid flow pressure in the wellbore, a drag force of fluid flow in the wellbore, and a type of fluid flow in the wellbore. A critical total strain is determined for the formation using the first set of characteristics and the relationship. The critical total strain is calibrated using a thick wall test.

13 Claims, 6 Drawing Sheets

OTHER PUBLICATIONS

McLean et al., "Wellbore Stability Analysis: A Review of Current Methods of Analysis and Their Field Application", 1990, IADC/SPE Drilling Conference, Houston, TX, pp. 261-274.

Fleming et al., "The Applicationof "Mechanical" Borehole Stability Theory to Development Well Planning", 1990, IADC/SPE Drilling Conference, Houston, TX, pp. 283-289.

Perkins et al., Stability and Failure of Spherical Cavities in Unconsolidated Sand and Weakly Consolidated Rock, 1988, 63rd Annual Technical Conference and Exhibition of the Society of Petroleum Engineers, Houston, TX, pp. 613-626.

Weingarten et al., "Prediction of Sand Production in Gas Wells: Methods and Gulf of Mexico Case Studies", Society of Petroleum Engineers, Jul. 1995, JPT, pp. 596-600.

Venkitaraman et al., Experimental Investigation of Sanding Propensity for the Andrew Completion, 1998 SPE International Conference on Horizontal Well Technology, Calgary, Canada, Nov. 1998, 1-7.

Ewy, "Wellbore-Stability Predictions by Use of a Modified Lade Criterion", SPE Drill. & Completion 14(2), Jun. 1999, pp. 85-91.

Bazanti, "Sand Production Model for Safania Field, Saudi Arabia", 1988, Society of Petroleum Engineers, pp. 1-22.

Kanj et al., "Realistic Sanding Predictions: A Neural Approach", 1999 SPE annual Technical Conference and Exhibition, Houston, TX Oct. 199, pp. 1-10.

Antheunis et al., "Perforation Collapse: Failure of Perforated Friable Sandstones", 1976, American Institute of Mining, Metallurgical, and Petroleum Engineers, Inc., Amsterdam, Netherlands, Apr. 1976, pp. 1-13.

Stein et al., "Estimating the Maximum Production Rate Possible from Friable Sandstones Without Using Sand Control", Journal of Petroleum Technology, Sep. 1972, pp. 1157-1160.

Stein et al., "Estimating the Maximum Production Rates From Friable Sands for Different Well Completion Geometries", Journal of Petroleum Technology, Oct. 1974, pp. 1156-1158.

Cheatham, Jr., "Strain Hardening of a Porous Limestone", Society of Petroleum Engineers Journal, Sep. 1967, pp. 229-234.

El-Sayed, Maximum Allowable Production Rates From Openhole Horizontal Wells, SPE Middle East Oil Show, Bahrain, Nov. 1991, pp. 395-406.

Fuh et al., "Sand Control—Reservoir formation failure and sanding prediction for well-construction and completion design", 2006 SPE Annual Technical Conference and Exhibition, San Antonio, TX, Sep. 2006, pp. 1-12.

Santos et al., "Wellbore Stability: A New Conceptual Approach Based on Energy", 1998 SPE Annual Technical Conference and Exhibition, New Orleans, Louisiana, Sep. 1998, pp. 805-815.

Santarelli et al., "Wellbore-Stability Analysis Made Easy and Practical", SPE Drilling & Completion, Dec. 1997, prepared for SPE/IADC Drilling Conference in New Orleans Mar. 1996, pp. 212-218.

Lowrey et al., "An Assessment of the Mechanical Stability of Wells Offshore Nigeria", SPE Drilling & Completion, Mar. 1995, first presented at SPE Annual Technical Conference and Exhibition in Houston, TX, Oct. 1993, pp. 34-41.

Sanfilippo et al., "Sand Production: From Prediction to Management", 1997 SPE European Formation Damage Conference, The Hague, Netherlands, Jun. 1997, pp. 389-398.

Holt et al., "Rock Mechanical Analysis of North Sea Reservoir Formations", SPE Formation Evaluation, Mar. 1989, first presented at 1987 SPE Annual Technical Conference and Exhibition, Dallas, TX, pp. 33-37.

* cited by examiner

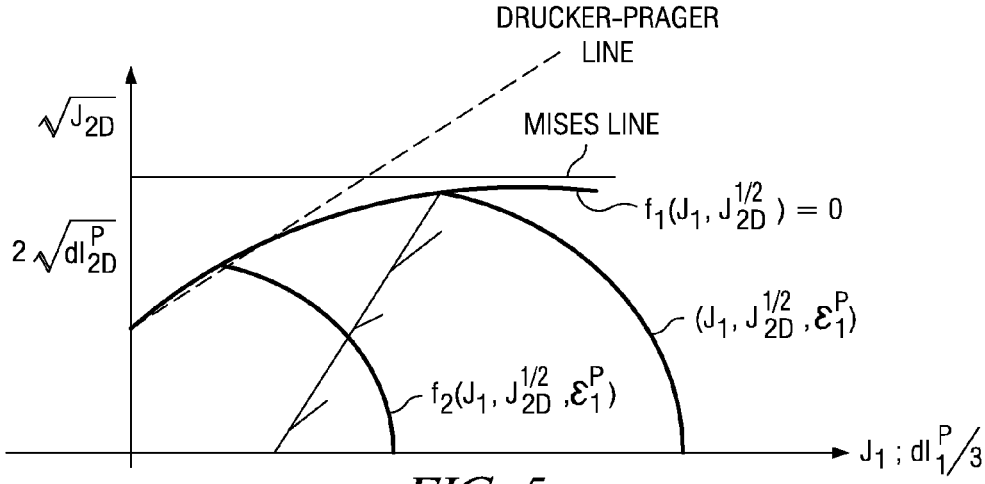

*FIG. 5*
*(PRIOR ART)*

COMMONLY USED METHODS FOR STRESS DIRECTION DETERMINATION

| METHODS | ANALYSIS TYPE | SPECIFICATIONS | LIMITATIONS |
|---|---|---|---|
| LOG BASED | BREAKOUT ANALYSIS | DIPMETER | VERTICAL |
| | INDUCED FRACTURES | IMAGE, BOREHOLE IMAGERS | VERTICAL |
| CORE | DIFFERENTIAL STRAIN CURVE ANALYSIS | SANDSTONE | VERTICAL |
| | ANELASTIC STRAIN RECOVERY | SANDSTONE | VERTICAL |
| | ACOUSTIC, Vp, AND Vs | SANDSTONE | VERTICAL |
| | CORE SPLITTING/DISKING | SANDSTONE | VERTICAL |

*FIG. 6*
*(PRIOR ART)*

DETERMINATION OF POINT OF SAND PRODUCTION INITIATION IN WELLBORES USING RESIDUAL DEFORMATION CHARACTERISTICS AND REAL TIME MONITORING OF SAND PRODUCTION

FIELD OF THE INVENTION

This invention relates to methods and systems for use in drilling completion and production technologies. In particular, the invention provides methods, apparatuses and systems for more effectively and efficiently predicting when compaction, depletion, and particularly sand production will occur in oil and gas production wellbores.

BACKGROUND OF THE INVENTION

The mining, oil, and gas industries drill boreholes in the subsurface of the Earth, with some boreholes exceeding a few miles. Through such boreholes, also called wellbores, oil and/or gas can be collected from deep within the Earth formations. However, many physical challenges often must be overcome in order to collect such hydrocarbons and any other fluids. For example, the walls of the borehole may collapse or fracture in an undesired manner, which can cause a wellbore to cease production. Even if a wellbore does not collapse, a nearly ubiquitous problem is the production of sand from inside the wellbore.

Sand production is a process in which small particles of rock or other subsurface materials move from the wellbore wall, or from within pores or fractures in the wellbore and from perforations in the wall, into the flow of fluids produced by the wellbore. Thus, the oil or gas collected at the oil rig through the wellbore is contaminated with sand. Sand in collected fluids can cause many problems, including a requirement to remove the sand from the fluid, a requirement to clean the sand of fluids once the sand is removed, sand-induced wear and tear on equipment, erosion and ultimate collapse of the wellbore itself, and many other problems. As a result, the oil and gas industry spends many billions of dollars each year on equipment and technologies to deal with produced sand and on equipment and technologies to mitigate sand production.

One method of mitigating sand production is to predict when sand will be produced at a particular well. Armed with the knowledge of when sand production will occur in a particular wellbore, engineers can avoid actions that will lead to sand production. Alternatively, if sand production is unavoidable, engineers can set up selected sand control procedures and equipment in such a way as to maximize the production of fluids, minimize the production of sand, and deal with sand that is produced.

As described further below, some techniques for predicting sand production are known. However, sand production has a variety of causes, some of which depend on factors that are unique to each wellbore. Hence, sand production can be very difficult to predict accurately.

However, the oil and gas industry considers accurate prediction of sand production to be very important. Implementation of sand mitigation systems or sand control systems is very expensive, and should be avoided if possible. Additionally, the correct sand mitigation systems or sand control systems for a particular wellbore should be chosen from many available systems. Furthermore, potentially catastrophic consequences of failing to predict sand production accurately can occur, such as the complete failure of a wellbore and possibly a drilling site. If a failed drilling site is a relatively immovable off-shore oil rig, then failure to predict sand production accurately potentially can result in the loss of billions of dollars. To date, no complete solution exists for accurately predicting when, and under what in-situ stress conditions, sand will be produced at any given wellbore. Specifically, existing models can not predict deformation and compaction-induced change of strength characteristics that trigger sand production.

SUMMARY OF THE INVENTION

The illustrative embodiments provide for a computer program product, data processing system, and computer-implemented method of predicting a start point at which sand production will begin at a production zone in a wellbore of a production facility. A first set of characteristics is determined for a formation in the production zone, wherein determining uses a plastic model of the formation. The first set of characteristics comprises a yield surface, a failure surface, a stress total strain, an elastic strain, and a plastic-strain relationship. A relationship is determined among a second set of characteristics of the wellbore using an effective stress model. The second set of characteristics comprises a drawdown pressure, a production rate, pore pressure, a temperature, and a viscosity of a fluid in the wellbore, a temperature of the production zone, a fluid flow pressure in the wellbore, a drag force of fluid flow in the wellbore, and a type of fluid flow in the wellbore. A critical total strain is determined for the formation using the first set of characteristics and the relationship. The critical total strain is calibrated using a thick wall test performed under in-situ conditions, wherein a calibrated critical total strain is formed. The calibrated critical total strain is stored, wherein the calibrated critical total strain comprises the start point.

In another illustrative embodiment, real time prediction is made as to when the formation will yield. Predicting is performed using the first set of characteristics and the relationship. In another illustrative embodiment, a real time prediction is made as to when the formation will fail. Again, predicting is performed using the first set of characteristics and the relationship.

In another illustrative embodiment, the first set of characteristics further comprises at least one of a porosity of the formation, wetability characteristics of the formation, a permeability of the formation, an average particle size of a material of the formation, and a distribution of particles in the material of the formation. In another illustrative embodiment, the first set of characteristics comprises at least all three effective stresses in the formation, including an effective overburden in the formation, an effective maximum horizontal stress of the formation, and an effective minimum horizontal stress of the formation.

In another illustrative embodiment, the start point is displayed on a graph of first stress invariants and second stress invariants of the formation. In another illustrative embodiment, a current stress point for the formation is measured. The current stress point is then displayed on the graph.

In another illustrative embodiment, a change is implemented for a parameter of production of the fluid from the wellbore based on a position of the current stress point relative to the start point. In another illustrative embodiment, the parameter comprises at least one of a bottom hole fluid pressure in the wellbore and a fluid flow type in the wellbore. In another illustrative embodiment, a determination is made as to whether sand mitigation systems should be installed in the wellbore based on a position of the current stress point relative to the start point.

In another illustrative embodiment, the current stress point is equal to or greater than the start point. In this case, an approximation is made as to an amount of sand that will be produced from the formation as a result of the production of the fluid from the formation.

In another illustrative embodiment, the wellbore comprises a first zone and a second zone. The formation is a part of only one of the first zone and the second zone. In this case, a determination is made as to whether the formation is in the first zone or in the second zone. Responsive to a determination that the formation is in the first zone, production of the fluid is shut down in the first zone. In another illustrative embodiment, the first zone and the second zone are monitored independently In another illustrative embodiment, production of the fluid continues in the second zone.

In another illustrative embodiment, a change is implemented in a parameter of production of the fluid from the wellbore based on the start point. In another illustrative embodiment, a determination is made as to whether sand mitigation systems should be installed in the wellbore based on the start point.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

FIG. 5 is a table illustrating commonly used prior art methods for determining stress direction;

FIG. 6 is a graph of a Drucker-Prager failure envelope and an elliptical plastic model, as known in the prior art;

DETAILED DESCRIPTION OF THE DRAWINGS

In the following detailed description of the preferred embodiments and other embodiments of the invention, reference is made to the accompanying drawings. It is to be understood that those of skill in the art will readily see other embodiments and changes may be made without departing from the scope of the invention.

This document is organized into three sections. The first section, which includes FIG. 1 through FIG. 3, describes computers for use in predicting sand production in a wellbore and also describes, for context, a broad overview of an oil platform. The second section, which includes FIG. 4 through FIG. 7, describes the state of the art of prediction of sand production in wellbores. Note that some reference may be made to the illustrative embodiments in the text describing FIG. 1 through FIG. 7; therefore, not all text referring to those figures is necessarily prior art. The third section, which includes FIG. 8 through FIGS. 9A and 9B, describes advances in the art of predicting sand production in wellbores.

Section 1: Computing Systems and Platform Overview

Figure 1:
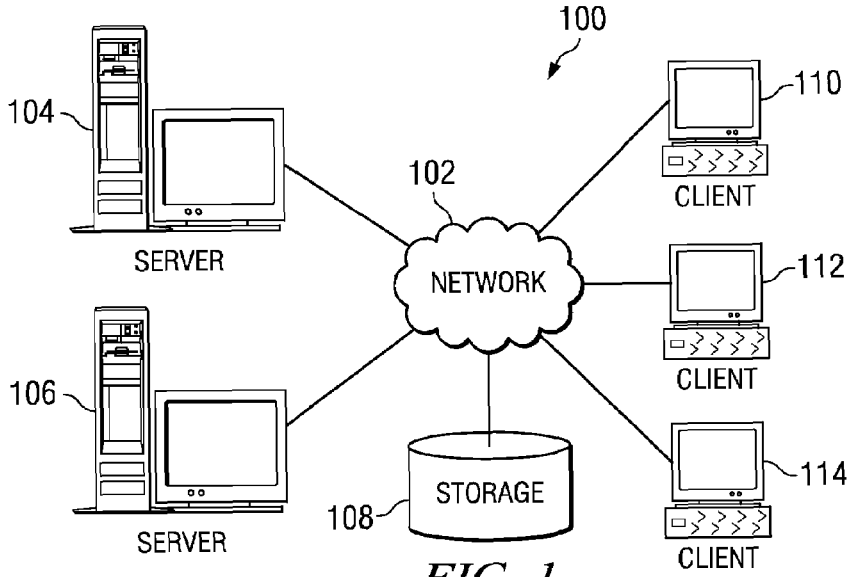
FIG. 1 (PRIOR ART)
FIG. 1 is a pictorial representation of a prior art data processing system in which aspects of the illustrative embodiments may be implemented.
Figure 2:
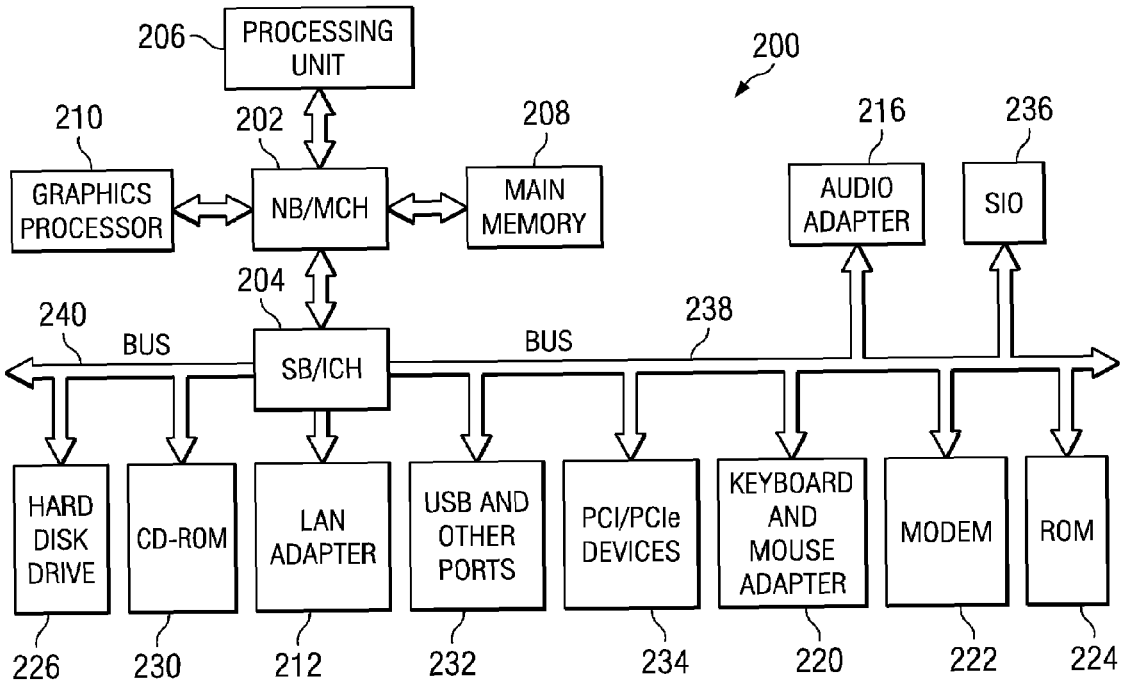
FIG. 2 (PRIOR ART)
FIG. 2 is a block diagram of a prior art data processing system in which aspects of the illustrative embodiments may be implemented.

FIG. 1 and FIG. 2 show exemplary diagrams of data processing environments in which illustrative embodiments may be implemented. FIGS. 1 and 2 are only exemplary and are not intended to assert or imply any limitation with regard to the environments in which different embodiments may be implemented. Many modifications to the depicted environments may be made.

FIG. 1 is pictorial representation of a network of data processing systems in which illustrative embodiments may be implemented. Network data processing system 100 is a network of computers in which the illustrative embodiments may be implemented. Network data processing system 100 contains network 102, which is the medium used to provide communications links between various devices and computers connected together within network data processing system 100. Network 102 may include connections, such as wire, wireless communication links, or fiber optic cables.

In the depicted example, server 104 and server 106 connect to network 102 along with storage unit 108. In addition, clients 110, 112, and 114 connect to network 102. Clients 110, 112, and 114 may be, for example, personal computers or network computers. In the depicted example, server 104 provides data, such as boot files, operating system images, and applications to clients 110, 112, and 114. Clients 110, 112, and 114 are clients to server 104 in this example. Network data processing system 100 may include additional servers, clients, and other devices not shown.

In the depicted example, network data processing system 100 is the Internet with network 102 representing a worldwide collection of networks and gateways that use the Transmission Control Protocol/Internet Protocol (TCP/IP) suite of protocols to communicate with one another. At the heart of the Internet is a backbone of high-speed data communication lines between major nodes or host computers, consisting of thousands of commercial, governmental, educational and other computer systems that route data and messages. Of course, network data processing system 100 also may be implemented as a number of different types of networks, such as for example, an intranet, a local area network (LAN), or a wide area network (WAN). FIG. 1 is intended as an example, and not as an architectural limitation for the different illustrative embodiments.

With reference now to FIG. 2, a block diagram of a data processing system is shown in which illustrative embodiments may be implemented. Data processing system 200 is an example of a computer, such as server 104 or client 110 in FIG. 1, in which computer usable program code or instructions implementing the processes may be located for the illustrative embodiments.

In the depicted example, data processing system 200 employs a hub architecture including a north bridge and memory controller hub (NB/MCH) 202 and a south bridge and input/output (I/O) controller hub (SB/ICH) 204. Processing unit 206, main memory 208, and graphics processor 210 are coupled to north bridge and memory controller hub 202. Processing unit 206 may contain one or more processors and even may be implemented using one or more heterogeneous processor systems. Graphics processor 210 may be coupled to the NB/MCH through an accelerated graphics port (AGP), for example.

In the depicted example, local area network (LAN) adapter 212 is coupled to south bridge and I/O controller hub 204 and audio adapter 216, keyboard and mouse adapter 220, modem 222, read only memory (ROM) 224, universal serial bus (USB) and other ports 232, and PCI/PCIe devices 234 are coupled to south bridge and I/O controller hub 204 through bus 238, and hard disk drive (HDD) 226 and CD-ROM 230 are coupled to south bridge and I/O controller hub 204 through bus 240. PCI/PCIe devices may include, for example, Ethernet adapters, add-in cards, and PC cards for notebook computers. PCI uses a card bus controller, while PCIe does not. ROM 224 may be, for example, a flash binary input/output system (BIOS). Hard disk drive 226 and CD-ROM 230 may use, for example, an integrated drive electronics (IDE) or serial advanced technology attachment (SATA) interface. A super I/O (SIO) device 236 may be coupled to south bridge and I/O controller hub 204.

An operating system runs on processing unit 206 and coordinates and provides control of various components within data processing system 200 in FIG. 2. The operating system may be a commercially available operating system such as Microsoft® Windows® XP (Microsoft and Windows are trademarks of Microsoft Corporation in the United States, other countries, or both). An object oriented programming system, such as the Java™ programming system, may run in conjunction with the operating system and provides calls to the operating system from Java™ programs or applications executing on data processing system 200. Java™ and all Java™-based trademarks are trademarks of Sun Microsystems, Inc. in the United States, other countries, or both.

Instructions for the operating system, the object-oriented programming system, and applications or programs are located on storage devices, such as hard disk drive 226, and may be loaded into main memory 208 for execution by processing unit 206. The processes of the illustrative embodiments may be performed by processing unit 206 using computer implemented instructions, which may be located in a memory such as, for example, main memory 208, read only memory 224, or in one or more peripheral devices.

The hardware in FIGS. 1-2 may vary depending on the implementation. Other internal hardware or peripheral devices, such as flash memory, equivalent non-volatile memory, or optical disk drives and the like, may be used in addition to or in place of the hardware depicted in FIGS. 1-2. Also, the processes of the illustrative embodiments may be applied to a multiprocessor data processing system.

In some illustrative examples, data processing system 200 may be a personal digital assistant (PDA), which is generally configured with flash memory to provide non-volatile memory for storing operating system files and/or user-generated data. A bus system may be comprised of one or more buses, such as a system bus, an I/O bus and a PCI bus. Of course, the bus system may be implemented using any type of communications fabric or architecture that provides for a transfer of data between different components or devices attached to the fabric or architecture. A communications unit may include one or more devices used to transmit and receive data, such as a modem or a network adapter. A memory may be, for example, main memory 208 or a cache, such as found in north bridge and memory controller hub 202. A processing unit may include one or more processors or CPUs. The depicted examples in FIGS. 1-2 and above-described examples are not meant to imply architectural limitations. For example, data processing system 200 also may be a tablet computer, laptop computer, or telephone device in addition to taking the form of a PDA.

Figure 3:
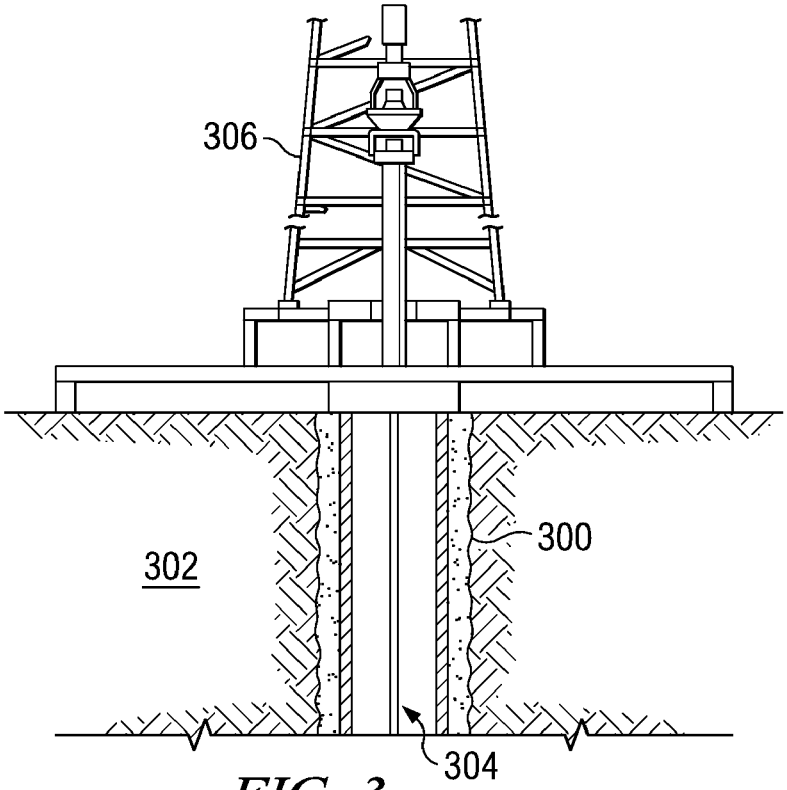
FIG. 3 (PRIOR ART)
FIG. 3 illustrates a prior art drilling mechanism drilling a borehole into the ground, in accordance with an illustrative embodiment.

FIG. 3 illustrates a drilling mechanism drilling a borehole into the ground, in accordance with an illustrative embodiment. FIG. 3 illustrates an overview of a drilling operation. Borehole 300 extends deep beneath ground 302. Although the depth of borehole 300 can be any particular depth, and thus could be as shallow as a few feet, the depth of borehole 300 can exceed a few miles or more for many petroleum industry applications. Borehole 300 is drilled with drilling tool 304, which in turn is supported by platform 306.

Various aspects of the drilling operation shown in FIG. 3 can be connected to one or more data processing systems, such as data processing system 100 shown in FIG. 1 and data processing system 200 shown in FIG. 2. For example, a measuring instrument, such as a sonic measuring tool can be inserted into borehole 300 in order to measure various properties regarding the rock surrounding borehole 300. Similarly, sensors or mechanical devices can be attached to a drilling tool 304 or platform 306 in order to measure various aspects of the drilling operation. These sensors or mechanical devices can be connected to a data processing system, such as data processing system 100 in FIG. 1 or data processing system 200 in FIG. 2.

The illustrative embodiments described herein can be implemented in data processing systems 100 of FIG. 1 and 200 of FIG. 2, with respect to a wellbore and an oil platform, such as borehole 300 and platform 306 of FIG. 3. The illustrative embodiments can be embodied as computer-usable program code in a computer readable medium, including those computer readable media described elsewhere herein.

Section 2: The State of the Art in Predicting Sand Production in Wellbores

Figure 4:
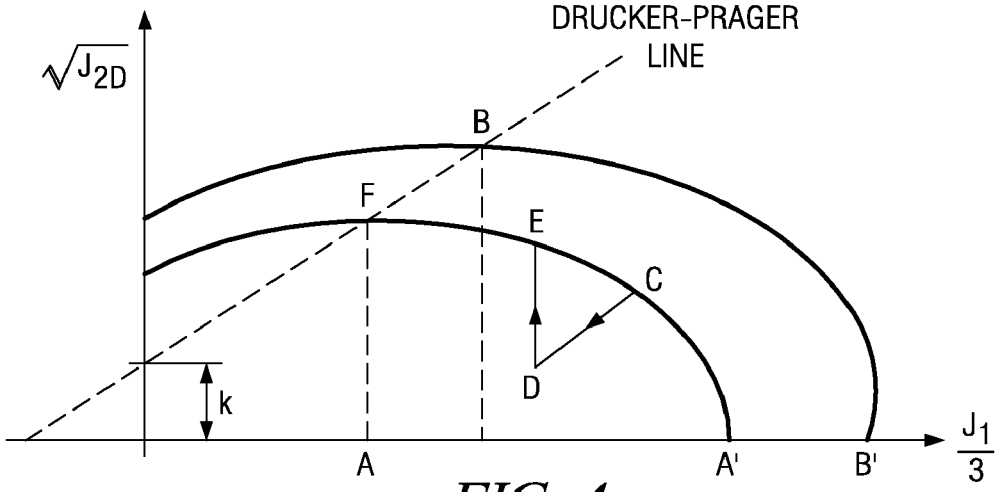
FIG. 4 (PRIOR ART)
FIG. 4 is a graph showing deformation and potential surfaces in stress space, as known in the prior art.

FIG. 4 is a graph of first stress invariants versus second stress invariants showing plastic strain increment vectors and potential surfaces, as known in the prior art. For the plastic failure criterion, the loading function is assumed to be isotropic and to consist of two parts: a failure envelope which serves to limit maximum shear stress in the material and a strain hardening surface. The failure envelope portion of the loading function is denoted by $$f_f(J_1, J_{2D}^{1/2}) = 0$$

or $$\sqrt{J_{2D}} = \alpha - \theta J_1 - \gamma \exp(\beta J_1)$$

and the strain-hardening surface by $$f_f(J_1, J_{2D}^{1/2}, \kappa) = 0$$

These equations indicate that the strain-hardening surface is not fixed in principal stress space and that it changes as plastic deformation takes place, where the plastic loading criteria are given by;

$$\frac{\partial f}{\partial \sigma_{ij}} d\sigma_{ij} \begin{cases} > 0 & \text{Loading} \\ < 0 & \text{Unloading} \end{cases}$$

Plastic strain will occur only when loading. During unloading or neutral loading, the material will behave elastically. The prescription that neutral loading produces no plastic strain is called the continuity condition. Within the elastic range, the behavior of the material can be described by an elastic constitutive relation of the type:

$$d\varepsilon_{ij}^{E} = \frac{ds_{ij}}{2G} + \frac{(dJ_1)\delta_{ij}}{9K}$$

where $$ds_{ij} = d\sigma_{ij} - \frac{1}{3}dJ_1\delta_{ij}$$

is the increment of the stress deviator, which expresses the familiar Hooke's law. In order not to generate energy or hysteresis within the elastic range, the elastic behavior of the material must be path-independent.

The incremental plastic strain vectors, $d\epsilon_{ij}^{p}$ are normal to the plastic potential surface. Hence, the observed incremental plastic strain vectors can be used to find plastic surface potential (Q).

FIG. 5 is a graph of a Drucker-Prager failure envelope and an elliptical plastic model, as known in the prior art. FIG. 5 shows the direction of the incremental plastic strain vectors drawn at various points along a chosen stress path. Here the vectors are plotted in terms of $$\frac{dI_1^p}{3} \text{ and } 2\sqrt{I_{2D}^p}$$

as coordinate axes, which are superimposed on the $J_1,\sqrt{J_{2d}}$ stress space. Therefore, the work done due to plastic deformation can be expressed by $$dW^p = J_1\left(\frac{dI_1^p}{3}\right) + 2\sqrt{J_{2D}(d_{2D}^p}\,.$$

Formation Stress Measurement and Determination

To define the stress state completely within the formation at a given point in time, engineers must establish both the direction and the magnitude of the principal formation stresses. The direction of principal formation stresses can be obtained from field history, core tests, and on-site tests. The magnitude of individual stress components can be estimated with both various models and core tests or measured directly from leakoff tests (LOTs); extended leakoff tests (ELOTs), microfracs, and minifracs. Ideally, direct stress measurements should be performed in wells aligned with the preferred fracture plane. Formation stresses are not fixed quantities, but may change over time as a result of field operations, such as production and injection. Formation stress orientation and magnitude should thus be measured at critical decision points throughout the life of a field. Where the topographic surface in the area of interest is horizontal, it is generally accepted that the vertical stress is a principal stress and is equivalent to the total weight of the overburden ($\sigma_v$). As stated above, the overburden represents the mass of the entire rock body, including pore-filling material above the zone or formation of interest. Overburden can be calculated using the following equation:

$$\sigma(d) = \int_0^d \rho(z)dz$$

where, d=depth of interest and ρ(z)=density of formation and pore filling fluids at every point above the depth of interest. The formation density can be estimated with logs run in either the well being analyzed or in a nearby offset well.

If one of the three principal stresses acts in the vertical direction, the other two principal stresses will act in the horizontal plane. The other two principle stresses are referred to as the maximum ($\sigma_H$) and minimum ($\sigma_h$) horizontal stresses. In most areas of the world, one of the principal stresses can be assumed to be vertical. However, under certain conditions, geological activity or the proximity of extensive topographical features may affect the principal stress orientations. If significant topographical features, such as mountains or deep valleys are present in the area of interest, none of the principal stress directions may be vertical. This condition is also likely in the immediate vicinity of a salt dome, where the gradual upward flow of the salt through the overburden will alter the stress directions in the salt dome's immediate vicinity.

Under these conditions, none of the principal stresses may be vertical, and at most, one would be horizontal. General observations about the principal formation stress orientation can be made by noting the inclination of an induced hydraulic fracture. The preferred fracture plane for an induced hydraulic fracture will be perpendicular to the minimum principal formation stress. Generally, only the minimum principal formation stress can be measured directly. The other stresses must either be inferred from the minimum stress or estimated based on geological or field conditions.

A goal during the fluid production phase of a wellbore is to minimize the wellbore pressure to maximize production. As the wellbore pressure is minimized, the stress state within the formation in the immediate vicinity of the wellbore and perforation moves closer to the edge of the failure envelope and may eventually move outside it. In order to prevent massive formation failure and avoid excessive sand production, the perforations in the wellbore are kept stable and a maximum drawdown limit may be required. If this drawdown limit is exceeded, then sand production should be expected.

To calculate the maximum drawdown, the pore pressure within the formation in the immediate vicinity of the wellbore is assumed to be equal to the wellbore pressure. Under this assumption, the minimum principal stress at the wellbore wall most likely will be the radial stress. Once the maximum allowable equilibrium drawdown is determined, the maximum allowable equilibrium drawdown can be used to determine the maximum allowable production rate.

In addition to this maximum allowable drawdown, a formula is also specified to bring the well on production. This process involves several steps of incremental drawdowns until the maximum allowable drawdown is reached.

FIG. 6 is a table illustrating commonly used prior art methods for determining stress direction in various fault regimes. Accurate stress direction is one of the important parameters for prediction of sanding potential. The most commonly used method for determining stress directions in the petroleum industry is known as breakout analysis. The breakout is the cross sectional elongation of a vertical hole. The breakout is oriented in the minimum stress direction. Thus, the breakout is oriented perpendicular to the maximum horizontal stress direction. On stress maps, either of the breakout direction or the maximum horizontal stress direction is used. Breakouts and other stress data have been used to construct stress maps for areas around the globe, as a part of the World Stress Map project, which specifically tries to identify regional crustal stress directions.

$\sigma_v > \sigma_{H\,max} > \sigma_{h\,min} \Leftrightarrow$ NormalFaulting $\sigma_{H\,max} \geqq \sigma_v \geqq \sigma_{h\,min} \Leftrightarrow$ StrikeSlip $\sigma_{H\,max} > \sigma_{h\,min} > \sigma_v \Leftrightarrow$ ReverseFaulting The methods used for stress direction determination are summarized in FIG. 6. The methods most commonly used are breakout analysis and induced fractures, which will be described in a more detail. Core data can also be used, but multiple sampling should be done to obtain reliable stress determinations. When the geological stresses are equal, a uniform over gauge hole occurs. When the geological stresses are unequal, failure of the wellbore occurs only in the direction of the minimum stress acting on the wellbore. As a result, an elliptical shaped hole is produced.

Breakouts form in the direction perpendicular to the maximum stress which acts across the cross-section of the borehole. To obtain the horizontal stress directions in an area, the breakouts observed in vertical wells are used. Induced fractures form when the well pressure exceeds the tensile stress of the wellbore. These fractures, also known as tensile fractures, occur in a direction perpendicular to the position of the breakouts. Thus, the tensile fractures form parallel to the maximum horizontal stress direction in vertical wells. When using induced fractures for stress direction studies, images from near vertical wells should be used.

The use of breakouts and induced fractures, as determined from logs for stress direction determination, generally requires a vertical well, as the geological stresses are assumed to be oriented in a vertical and horizontal direction. If the stresses are not aligned horizontally and vertically, such as in the presence of severe faulting and folding, the interpretation of stress direction is much more complex.

Core samples from the wellbore can be used to obtain stress directions from vertical wells. Two different types of core analysis can be used for stress determination. The first is the direct observation of the core. If the in-situ stresses are large enough compared to the rock strength, cores can contain two artifacts, core disking and axial core splitting. Both types of core damage normally occur in relatively competent formations in tectonically stressed regions. Core discs are the saddle shaped splitting of the core (perpendicular to the axis of the cores), and are formed by the stress concentrations which develop around the bottom of the core during the coring process. The upper edges or peaks of the saddle indicate the direction of the minimum horizontal stress.

Core splitting occurs due to the coalescence of microfractures which are generated during coring and stress relief upon bringing the core to the surface. The core splitting occurs in the direction of the minimum horizontal stress direction. This technique for determining the horizontal stress directions can only be used in vertical wells. The second type of core-based stress measurement involves taking a core and measuring the expansion of the core as the core reaches the rig. This type of measurement is called anelastic strain recovery.

The Plastic Model

The plastic model is a continuum material model for rock formations. The plastic model is based on the classical incremental theory of plasticity. The yield function used in the original plastic model included a perfectly-plastic portion fitted to a strain-hardening elliptical curve. An associated flow rule was employed for the failure and plastic model functions. In this original plastic model, the functional forms for both the perfectly-plastic and the strain-hardening portions were quite general and would allow for the fitting of a wide range of material properties. Plastic models have been used to represent both the high and low pressure mechanical behaviors of a number of geological materials, including sands, clays and various types of rocks.

For the plastic model, the loading function is assumed to be isotropic and to consist of two parts. The first part is a failure envelope which serves to limit maximum shear stress in the material and a strain hardening surface. The failure envelope portion of the loading function is denoted by:

$$f_f(J_1, J_{2D}^{1/2}) = 0 \tag{1}$$

The second part is the strain-hardening surface. This portion of the loading function is denoted by:

$$f_f(J_1, J_{2D}^{1/2}, \kappa) = 0 \tag{2}$$

Equations (1) and (2) indicate that the strain-hardening surface is not fixed in the principal stress space and that it changes as plastic deformation takes place. The plastic loading criteria for the function f are given by:

$$a.\ \frac{\partial f}{\partial \sigma_{ij}} \partial \sigma_{ij} > \text{Loading, and } \frac{\partial f}{\partial \sigma_{ij}} \partial \sigma_{ij} < \text{Unloading} \tag{3}$$

Plastic strain will occur only when $\partial f > 0$. During unloading or neutral loading, the material will behave elastically. The prescription that neutral loading produces no plastic strain is called the continuity condition.

Within the elastic range, the behavior of the material can be described by an elastic constitutive relation of the type:

$$d\varepsilon_{ij}^{E} = \frac{1}{2G} ds_{ij} + \frac{1}{9K} dJ_1 \delta_{ij} \tag{4}$$

where $ds_{ij}$ is the increment of the stress deviator and $\delta_{ij}$ is the Kronecker delta. The bulk and shear module are K and G, respectively. Equation (4) expresses Hooke's Law. In order not to generate energy or hysteresis within the elastic range, the elastic behavior of the material is path-independent.

The failure envelope and plastic model surfaces are given by:

$$f_1 = \sqrt{J_{2D}} - \alpha J_1 - K \tag{5}$$

$$\sqrt{J_{2D}} R^2 = (X - L)^2 + (J_1 - L)^2 \tag{6}$$

The horizontal tangential condition of the plastic model, where it intersects the failure envelope, is guaranteed by the following relationships between L and X:

$$X = L + R(\alpha L + K) \tag{7}$$

The value of X, which is the hardening parameter, is a function of the plastic volumetric strain and is expressed as $$X = \frac{1}{D} \ln\left(1 - \frac{\varepsilon_v^p}{W}\right) \tag{8}$$

where D, Z, and W are the material parameters to be determined.

Equation (37) can be rearranged as follows:

$$X = \frac{1}{D}\ln\left(1 - \frac{\varepsilon_v^p}{W}\right) + Z \tag{9}$$

The volumetric strain increments for the failure envelope and for the plastic model can be obtained from equations (5) and (6) as follows:

$$d\varepsilon_{min} = \frac{dJ_1}{3K} + D(W - \varepsilon_{min}^p)dX \tag{10}$$

The total volumetric strain is:

$$\varepsilon_v = \varepsilon_v^e + \varepsilon_v^p = \frac{J_1}{3K} + W[1 - \exp(-JD)] \tag{11}$$

Equation (11) provides a complete specification for the deformation response of the soil subjected to a state of stress. Substitution of Equations (9) and (10) into Equation (6) results in the following equation:

$$J_{2D}R^2 = \left(-\frac{1}{D}\ln\left(1 - \frac{\varepsilon_v^p}{W}\right) + Z - \frac{J_1 - Rk}{1 - R\alpha}\right)^2 + \left(J_1 - \frac{J_1 - Rk}{1 - R\alpha}\right)^2 \tag{12}$$

Equation 12 is the final equation for a failure envelope and elliptical potential surface. The plastic model satisfies Drucker's stability postulate, a postulate known in the art, and the plastic model leads to a unique solution for a boundary value problem.

Figure 7:
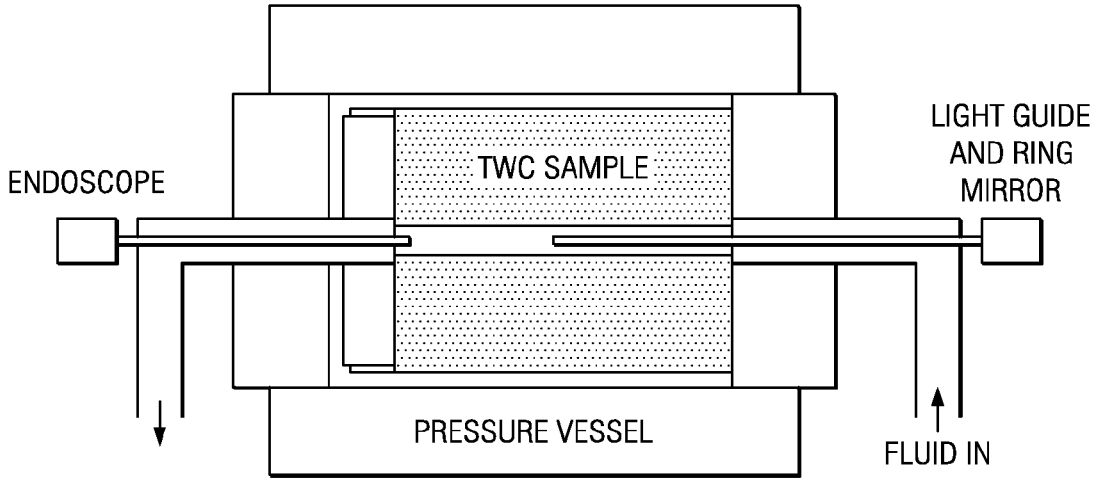
FIG. 7 (PRIOR ART)
FIG. 7 illustrates a thick wall cylinder testing apparatus, as known in the prior art.

FIG. 7 illustrates a thick wall cylinder testing apparatus, as known in the prior art. FIG. 7 shows a typical thick wall rock sample test under in-situ stress, temperature, and draw down conditions.

While producing the well, operators usually adjust downhole conditions to ensure that the formation will neither shift nor fail during the well's productive life. As described above, the possibility of borehole failure depends on the strength of each rock type encountered. Maintaining perforation stability and openhole stability requires a proper balance between in-situ rock stresses, pore pressure, and rock strength, and wellbore fluid pressure. For formation stability, wellbore and near-wellbore pore pressures must be adjusted to balance formation and near-wellbore stresses with the strength of the formation. If the stresses become too great, the borehole, perforation, or formation may fail.

During drilling, operators may have to restrict drilling mud to a certain weight range to prevent borehole failure resulting from collapse (borehole spalling), failure in tension (hydraulic fracturing), and the flow of pore fluid into the wellbore and up to the surface.

During production, operators balance downhole producing conditions, such as well operating pressure and drawdown, to maximize production while still avoiding failure of the formation face. This failure could result in the production of sand, which could possibly fill the borehole. Over the life of the field, reservoir depletion can result in pore collapse and formation movement. Therefore, operators may choose to minimize formation compaction by initiating a pressure maintenance scheme that keeps the pore pressure at acceptable levels. To predict the conditions of formation failure and identify operating conditions to minimize likelihood of formation failure, a number of facts must be known, including the stresses within the formation, the forces or stresses applied at all free surfaces, the nature and pressure of the pore-filling material (fluid or gas), the formation strength, and the potential interaction of wellbore fluids with the formation matrix.

Failure of a Formation

A wellbore is said to have failed if stress concentration around a wellbore or stress concentration around a perforation in the wellbore exceeds the strength of the rock. The result of failure is sand production. The problems associated with sand production include sand bridging in the casing, tubing, and/or flow lines, casing or liner failure, abrasion of downhole and surface equipment, or handling and disposal problems of produced formation materials.

This fact creates the following quandary. From a purely scientific standpoint, we should be able to always accurately predict failure on the basis of theory. To apply our predictions to operations, however, additional requirements should be considered, such as maximum allowable sand production rate, borehole geometry variations, maximum borehole damage or geometry variations, and other considerations. By tempering scientific predictions with these operational considerations, the onset of actual failure can be predicted, and then operating parameters can be adjusted to prevent failure based on field experience or operational observations.

The following examples of constraints show how constraints can impact well productivity and sand production potential. In a first example, to maintain high recovery from a reservoir containing hydrocarbons with a high bubble point, reservoir pressure and well pressure should remain above the bubble point. In a second example, to prevent excessive equipment erosion, the production rate may be limited as controlled by drawdown. In a third example, lower production rates can add flexibility to completion designs for minimizing sand production. In a fourth example, weak and highly permeable formations may be damaged during drilling, gravel-packing, and workover operations. As a result, more drawdown is required to maintain production rates and reduce the well's productivity index. In a fifth example, sand produced with viscous oils from low-productivity reservoirs may have insufficient velocity to damage surface facilities. In such cases, sand production may be acceptable.

Borehole and Formation Failure Modes

Depending on the current stage of the well, different failure mechanisms may be active. Two specific stages of a well's life that are of particular interest include: First, the initial drilling and completion stage and, second, the production stage through the remainder of a well's and/or field's life.

Drilling- and Completion-Related Failures

Possible borehole failures occurring during drilling and completion can be classified according to the following criteria: A first criteria is compressive shear failure resulting in hole enlargement. These failures occur as brittle rock falls into the borehole, usually as a result of insufficient mud weight. Failures of this type include borehole breakouts, sloughing, spalling, or cave-ins.

A second criterion is tensile fracturing of the formation resulting from excessive fluid pressure within the borehole. This type of failure often results in lost-circulation problems while the well is being drilled. Tensile fracturing may cause multiple fractures to initiate during subsequent fracture-stimulation treatments.

A third criteria is reduced hole size as a result of plastic flow of the formation into the borehole. This failure can occur in clayey sand, shale, or in salt layers.

Production-Related Failures

During the production phase of a well's life, the onset or cessation of sand production are two areas of concern regarding wellbore/perforation stability. Generally, sand production should be avoided. Sand production from a well can result from either shear or tensile failures within the formation.

Shear Failure

Shear failures occur at the perforation or in an open hole when the borehole pressure is significantly reduced, increasing near-wellbore stress.

Eventually, this stress can lead to formation failure. Shear failure most often occurs later in the life of the well as the reservoir pressure decreases. As the reservoir depletes, the stress carried by individual sand grains continues to increase until the well must be abandoned if pressure maintenance is not used. As the flowing bottom hole pressure is reduced to counteract reservoir depletion effects, the stress concentration at the surface of the perforation cavity or the open borehole increases, eventually leading to shear failure of the perforation or the open hole.

Tensile Failure

Tensile sand production failures occur when the near-wellbore porosity and permeability are significantly damaged or when flow rates are extremely high. Under either condition, the flowing fluid can exert significant drag forces on individual grains in the formation. If this drag force becomes excessive, the cementation between individual grains can fail, resulting in tensile failure and sand production. This type of failure is typically observed during perforation or borehole cleanup when the permeability in the near-wellbore region is damaged. Sand production increases the diameter of the perforation cavity or the borehole, reducing the support around the casing. As a result, perforations collapse, the cavity becomes larger, and eventually production from the wellbore ceases.

Time-Dependent Failure

Time-delayed borehole/perforation failures can also occur as a result of gradual changes in pore pressure related to effective stress, or as a result of plastic behavior of the formation, and as a result of temperature changes. For example, as the borehole gradually heats or cools in response to changes in wellbore fluid temperatures, the formation stresses in the near-wellbore region change. If this change is significant enough, borehole/perforation instabilities could result. Consolidation and creep are the two forms of time-dependent formation behavior. Consolidation is caused by pore pressure gradients induced within the formation as a result of abrupt changes in the stress state around the borehole. Over time, as this pore pressure gradient disappears and pore pressure equilibrium is re-established, the stress carried by individual rock grains continuously changes until equilibrium is reestablished.

If, at some point, this stress exceeds the formation's strength, formation instability and failure may result. Creep occurs in materials under a constant stress state. Creep can occur in both dry and saturated rocks; frequently, creep occurs in clayey sands, shales, and salt formations. Generally, creep is proportional to the second stress invariants in the material.

Predicting Borehole/Perforation Failure

The oil industry has developed numerous procedures to analyze or determine whether borehole failure could occur. Available prediction techniques range from field correlations to complicated numerical simulators.

Empirical Correlations

If a significant amount of field data is available, empirical correlations can be derived for a given field. Using these correlations, a determination can be made of the conditions under which the formation will be stable. A determination can also be made as to when to expect the formation to fail. When this approach is used, one or more critical, controllable parameters can be identified. The most widely used variable is borehole pressure or drawdown. More recently, the use of neural networks has been proposed to identify several parameters that can be simultaneously adjusted to avoid or delay sand production. The drawback with these methods is that they are all fields-specific and require a significant amount of operating experience. Therefore, new correlations must be derived for new fields.

Theoretical and Numerical Failure Prediction Techniques

The above-described techniques are generally based on the following procedure. First, determine the complete stress state and the mechanical properties for the formations to be evaluated. Stresses and properties are available from laboratory and in-situ measurements or they can be estimated from logs and correlations.

Second, calculate the complete stress state around each perforation of the borehole. These calculations can be performed by using either (a) linear elastic, closed-form solutions or (b) complicated numerical analyses involving linear elastic or plastic behavior.

Third, compare the stresses around the borehole to the formation's strength. If the stresses are greater than the formation's strength, formation instability may occur under the conditions being analyzed. To avoid failure, the wellbore/perforation conditions must be adjusted to lower the near-wellbore/perforation stresses within a safe range.

Fourth, if dealing with production, use the maximum allowable drawdown estimate based on failure criterion to estimate or determine the maximum expected production rate.

Fifth, verify any predictions by monitoring field performance. A wellbore/perforation stability analysis requires the following data: the complete in-situ stress state (magnitudes and directions of the principal stress components) and pore pressure within the formations of interest; the physical properties of the rock (strength, stiffness, deformation properties); and the geometry of the borehole/perforation. These properties can be determined from field tests, core tests performed in the laboratory, logs, empirical correlations, or sometimes, an educated guess.

Section 3: Advances in the Art of Prediction of Sand Production in Wellbores

As shown above, extensive work has been done on prediction of when sand production will occur. However, existing models can not predict residual deformation, depletion, and compaction-induced change of strength characteristics that trigger sand production. One unique value of the illustrative embodiments lies in the previously unknown realization that sand production is a function of residual strain characteristics of a reservoir.

The illustrative embodiments provide for a computer program product, data processing system, and computer-implemented method of predicting a start point at which sand production will begin at a production zone in a wellbore of a production facility. A first set of characteristics is determined for a formation in the production zone, wherein determining uses a plastic model of the formation. The first set of characteristics comprises a yield surface, a failure surface, a stress total strain, an elastic strain, and a plastic-strain relationship. A relationship is determined among a second set of characteristics of the wellbore using an effective stress model. The second set of characteristics comprises a drawdown pressure, a production rate, pore pressure, a temperature, and a viscosity of a fluid in the wellbore, a temperature of the production zone, a fluid flow pressure in the wellbore, a drag force of fluid flow in the wellbore, and a type of fluid flow in the wellbore. A critical total strain is determined for the formation using the first set of characteristics and the relationship. The critical total strain is calibrated using a thick wall test performed under in-situ conditions, wherein a calibrated critical total strain is formed. The calibrated critical total strain is stored, wherein the calibrated critical total strain comprises the start point.

Figure 8:
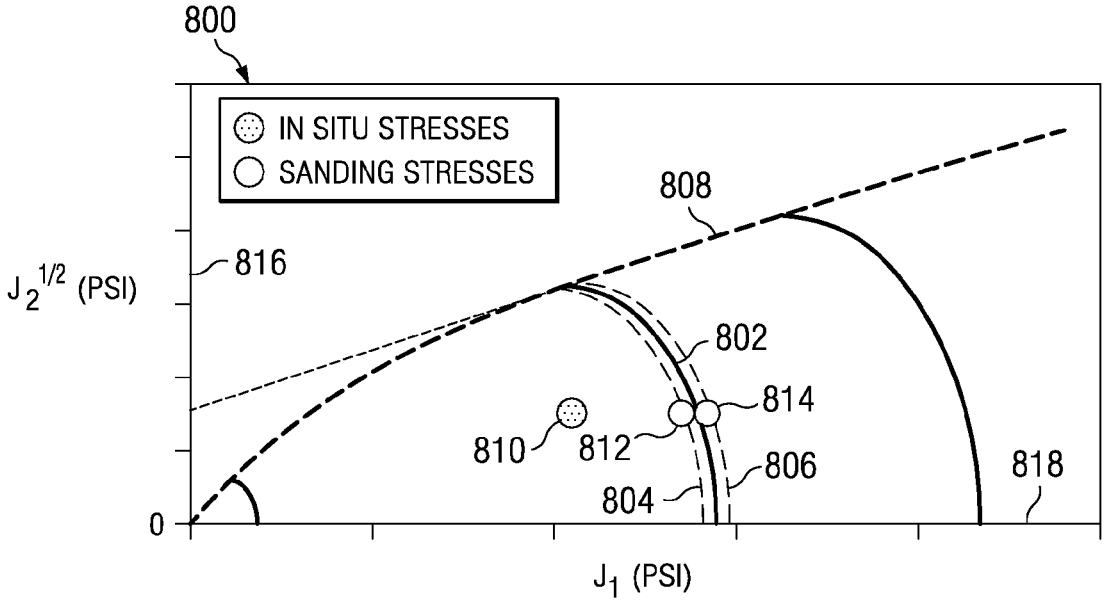
FIG. 8 is a graph of first stress invariants versus second stress invariants for a particular wellbore, wherein the graph shows the point of in-situ stresses in relation to a first curve of sand production initiation points and a second curve of wellbore collapse points, in accordance with an illustrative embodiment.

FIG. 8 is a graph of first stress invariants versus second stress invariants for a particular wellbore, wherein the graph shows the point of in-situ stresses in relation to a first curve of sand production initiation points and a second curve of wellbore collapse points, in accordance with an illustrative embodiment. The graph of FIG. 8 shows that sand production is a function of critical total strain. Until the illustrative embodiments described with respect to FIG. 8 was developed, this type of graph was unknown and a complete solution to sand prediction was thought to be not possible due to the complexity of sand prediction in actual wellbores. Graph 800 considers all three major stresses, including maximum horizontal stress, minimum horizontal stress, and intermediate stresses. Additionally, graph 800 takes into account pore pressure and the effect of fluid flow, type of fluid, and fluid mechanics on sand production in a wellbore. Additionally, graph 800 takes into account pore pressure, wellbore temperature, drawdown pressure, and critical deformation of the Earth formation surrounding a wellbore.

Graph 800 provides a means for real time monitoring of sand production, compaction, and deletion as a function of in-situ stress, reservoir pressure, wellbore temperature, drawdown pressure, pore pressure, production pressure, fluid mechanics, and production rate. No known means exists for real time monitoring of sand production in this manner.

As described above, the strains induced by reservoir depletion also induce changes of the mechanical parameters and of the petrophysical characteristics of the rock. The rock strength characteristics can thus drastically change during or after oil production. For example, during production permeability drops, the effect of drag forces induced by fluid flow increases, rock starts to disintegrate, sand and fine particles start to detach, and finally the wellbore reaches ultimate failure. In order to better understand the role of the effective stresses during the elastic, plastic post plastic phase, change of strains, acoustic properties, and porosity, strength characteristics of solid and thick wall cylinder core samples from various regions have been simultaneously measured.

Several loading paths have been investigated, with the solid and thick walled cylinder samples being loaded up to failure by applying various lateral pressures under constant mean stresses and isotropic stress conditions. Proportional loading is used to determine the critical elastic, plastic and total strains, to determine disintegration stresses of sand particles from the main body, and finally to determine yielding and failure stresses of the main body. Attention was paid to the degrees of total strains induced by isostatic pressure and pore pressure in order to emphasize the possible influence of the first and second stress invariants. The results were analyzed in order to provide evidence of the influence of the various stress paths and effective mean stress on deformation characteristics on solid and thick wall cylinders.

A sanding criterion can be defined in the stress space to determine when sanding will occur in a wellbore. The sanding criterion is obtained via the stress invariants stress limit for in-situ stresses of the producing zone of a reservoir and also by performing experiments at in-situ effective stresses.

Inside the first and second invariants stress space defined by the criterion, the sanding potential is changing within the change of the first invariant stress. The second invariant stress is independent from the reservoir pressure. However, compaction is a function of both the first and second stress invariants. These incremental changes of first and second invariants can be determined in real time as a function of the change of the fluid flow characteristics, flow rate, fluid flowing pressure and temperature, petrophysical characteristic of the formation including porosity, permeability, connate water, wet ability, particle size, and distribution, cementation material, and characteristics, such as strength of the material, type of material, mineral content of the material, and chemical characteristics of the mineral between the grains. This method leads to the conclusion that sanding coincides with critical total strain in a formation. This fact is illustrated by the results plotted on FIG. 8 for an actual deep water offshore reservoir having 23% porosity.

Graph 800 of FIG. 8 accounts for in-situ stress of the hydro carbon producing zone, critical total strains for the formation, critical total strain to start point of sand production, yielding point of the material of the formation at the production zone, elastic failure of the material of the formation at the production zone, plastic and total strains of the material of the formation at the production zone, and ultimate failure stresses at the in-situ location of the production zone. Each ellipsoidal curve indicates a constant volumetric strain at various stresses. Curve 802 from the left to right at the stress space indicates critical drawdown at various first and second stress invariants space. Curve 804 indicates the critical strain associated with initiation of sand production. Note that in FIG. 8, curve 802 and curve 804 are very close together and are nearly on top of each other. Curve 806 indicates the critical strain associated with ultimate failure of the production zone. Each of curves 802, 804, and 806 represents constant total strain at various first and second stress invariants space. Curves 802, 804, and 806 are based on thick wall cylinder test results performed under in-situ stress conditions. Deviated straight line 808 indicates failure surfaces of the producing zone at the stress space.

Dot 810 indicates the current, real-time in-situ stress and temperature of the formation. Empty dot 812 shows the point of critical strain and empty dot 814 shows the point of ultimate failure strain.

Note that axis 816 represents $\sqrt{J_2}$, which is a stress invariant, and axis 818 represents $J_1$, which is another stress invariant. The ellipsoidal curves in FIG. 8 show critical total strains at various stresses in the stress space. Deviated straight line 808 indicates the failure surface.

Thus, FIG. 8 provides a mechanism for real time sand production monitoring. Dot 810 shows in-situ stress at the pay zone. Dot 810 moves from right to left during monitoring. Empty dots 812 and 814 show the starting points of sand production and failure of the formation, respectively. During fluid production, when dot 810 reaches empty dot 812, sand production will begin. When dot 810 reaches empty dot 814, the wellbore is in danger of continuous sand production that cannot be stopped.

In use, an engineer monitors the graph shown in FIG. 8 in real time during oil and gas production. In response to the movement of dot 810, the engineer can adjust oil production, increase pressure in the wellbore, or take some other action in order to prevent the critical total strain from reaching a point where sand production will begin. For example, one or more of pressure in the wellbore, fluid flow characteristics, type of fluid flow, temperature of the fluid, temperature of the formation, and flow rate can be controlled to change the location of dot 810. Alternatively, if sand production is considered inevitable, then the engineer can cause properly-selected sand mitigation systems to be put into place.

Creation of Graph 800

The creation of graph 800 relies on a plastic mechanical earth model generated for a particular wellbore. This plastic mechanical earth model is a function of stress; elastic, plastic, and volumetric stress deformation; one or more strength characteristics of the formation; temperature of the formation; fluid content in the formation; flow type from the formation; fluid viscosity produced from formation; particle size of particles making up the material of the formation; particle distribution of particles making up the material of the formation; and type and content of minerals that are part of the formation. Versions of such models are known, as described above. However, also as described above, such models only consider volumetric total deformation. The plastic mechanical earth model generated for the creation of graph 800 also uses a second stage to compare the plastic mechanical earth model with residual deformation of the formation, by using an appropriate plastic, elasto-plastic model, as described further below.

After creating the complete plastic mechanical earth module, the model is calibrated by using three axial core test results under cyclic, in-situ stress conditions. This calibration can be used to add a factor in the model to include fatigue effects. Fatigue effects can be represented by a variable to represent the weakness of the production zone that is caused by stress loading and stress unloading. Fatigue effects can be determined using either laboratory core test data or existing models.

Fatigue occurs when a valve used for fluid production is opened and/or closed repeatedly. Each time fluid production stops and starts, a corresponding increase or decrease of stress occurs with respect to the stress on the formation. Eventually, formation will start to yield and, if left unchecked, ultimately will fail. As a result, fatigue means that sand production becomes inevitable.

The model used to produce graph 800 also includes erosion effects, tensional effects, temperature effects, compaction and depletion effects, and erosion effects by simulating viscous fluid flow through a realistic pore space numerically represented by pores and a mineral phase. The model also considers fluid flow characteristics, such as flow type and flow rate. The model also considers strain deformation and volumetric deformation from a plastic deformation model as a function of change of the total stresses, including reservoir stress, drawdown stress, and bottom hole pressures.

Once the plastic model based on the data collected and in-situ stresses has been determined, the stresses can be used to create a model of plastic strain, sand production initiation, and wellbore failure. Plastic deformations are calculated for the entire stress space to determine the critical sand production point, and to determine a relationship of failure stresses to corresponding in-situ stresses. The relationships are represented by curves 802, 804, and 806.

Thus, the illustrative embodiments provide for modeling of critical total strain. Critical total strain is the point at which sand production begins. The plastic mechanical earth model at the pay zone is established using a plastic model. Initial in-situ stresses of the pay zone are determined using existing models and techniques. Changing in-situ stress as a function of production is modeled and determined in real time. Additionally, critical drawdown pressure, critical flow rate, bottom hole producing pressure, change of deformation characteristics of the pay zone, and real time compaction characteristics (including deformation and stress path of the pay zone) are all modeled. These models are used to produce graph 800. Because the information of all relevant sources of stress and strain is complete, a real-time estimation can be made of the amount of sand produced at any given portion of any given wellbore at a given set of production conditions.

More specifically, a plastic model (such as a Drucker-Prager and/or plastic Model) is used to determine yield and failure surfaces of a formation. The plastic model is used to determine stress total strain, elastic strain and plastic strain relation. Effective stress is used for accurate determination of the in-situ stresses of the production zone.

Additionally, effective stress is used to determine the relation between drawdown pressure, wellbore flowing pressure, drag forces, and type of flow characteristic of producing fluid to determine critical strains. Critical strains include the total critical strain that will result in yield in the formation, critical strains that cause the start of disintegration of the formation at the production zone, and critical total strains that cause total failure of the rock at the production zone.

The critical elastic and plastic portions of the strains were determined using plastic failure criterions, in addition to critical total strains and yielding. Additionally, petrophysical characteristics of the production zone, such as porosity, permeability, and capillary forces (wet ability), are included in the plastic model to determine critical total, elastic, and plastic deformations that exist at the initiation of yielding in the formation, sand production, and formation failure.

An important aspect of this model is that critical strains are calibrated with thick wall test results performed under in-situ stress conditions. Thus, in-situ stress of the formation, sanding stresses, and yielding and failure stresses can be found.

Another important aspect of this model is that the plastic model considers all three principal stresses, including effective overburden stress, effective maximum horizontal stress, and effective minimum horizontal stress. Effective stress laws are used to determine effective stresses.

In an illustrative embodiment, a critical total strain is determined for various stresses. The stresses are represented by the ellipsoidal curves shown in FIG. 8. These curves represent a constant critical strain for entire stresses in the model at the stress space.

Determined in-situ stress and critical stresses and strains provide an important limit point, which is that stresses in the production zone only move between these stresses. The starting point is in-situ stress. If the bottom hole fluid pressure is decreased for higher production rate, the effective stress in the production zone will be increased, so that stresses in the well bore will start to become closer to the critical sanding stress and strains point. If bottom hole fluid pressure is going to be decreased more, stresses in the production zone will increase more and sand production will begin. If this point is exceeded, then the formation will fail.

In the past, these critical stress points could not be set. In the past, an assumption was made that sand production would occur only when in-situ stresses exceed failure stress surfaces, without any critical strains. However, critical strains are an important aspect of determining when sand production will occur.

The model of the illustrative embodiments proves that in-situ stresses and critical strains are independent from the second stress invariants (J2), but do depend on first stress invariants (J1). Thus, stresses in the production zone move only from left to right when bottom hole fluid pressure is decreased. Note that a decrease in bottom hole fluid pressure results in more oil and/or gas production. In turn, stresses will move from right to left when bottom hole fluid pressure is increased.

In an illustrative embodiment, a computer program monitors movement of the stresses from left to right and from right to left as a function of bottom hole fluid pressure and fluid characteristics, once in-situ stresses, critical yielding, sanding stress, and failure stresses are determined. Real time monitoring of the stresses and total strains allow for a change production policy before the formation will yield, produce sand, and/or fail.

By using this model, a determination can be made in real time as to the amount of sand that will be produced, if a decision is made to produce higher amounts of hydrocarbon close to critical stresses. Additionally, the illustrative embodiments can be implemented and monitored off-site, by using in-situ measurements. Thus, real-time monitoring can be performed off-site, thousands of miles from the production facility. An advantage of this feature is that production can continue even during severe weather. Another advantage of this feature is that, given automatic controls for oil or gas production, regulation of production can be performed automatically or through the use of remote commands. Additionally, little training is needed to use the program to monitor a well, because only a determination of where the moving dot is located relative to the graph at any one time need be made. Overall, the illustrative embodiments allow production policy to be determined in real time without going to a well site, and possibly without running expensive well tests.

Additionally, if more than one production zone exists, then each zone can be monitored independently. Thus, production can be optimized for an entire production operation that includes more than one zone. Furthermore, because the illustrative embodiments analyze each production zone independently from each other, the illustrative embodiments can determine from what production zone sand is being produced. Thus, an entire wellbore need not be shut down while expensive well testing is being performed.

Figure 9A:
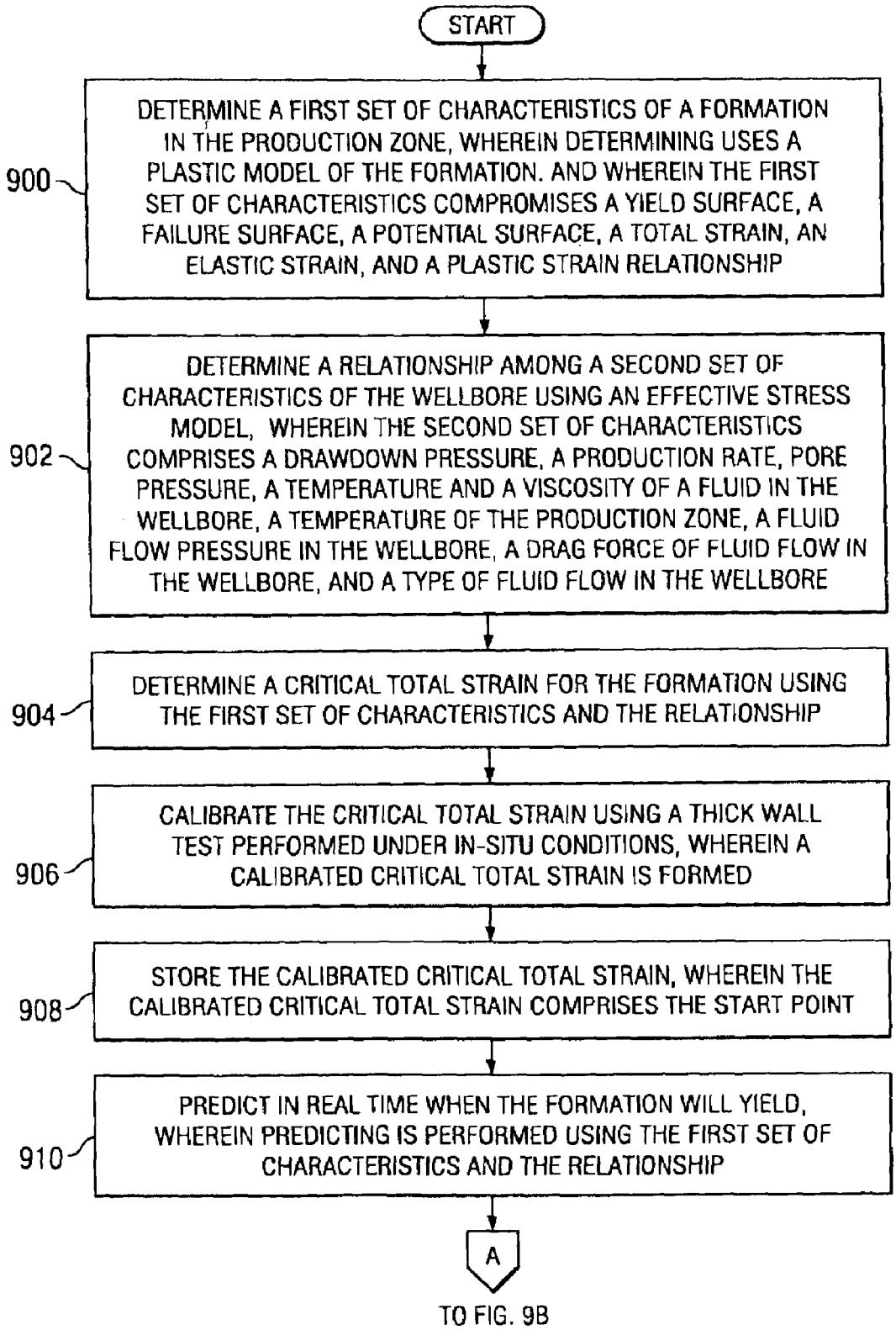
FIGS. 9A and 9B are a flowchart illustrating a process of controlling production of a fluid from a wellbore using the illustrative methods, in accordance with an illustrative embodiment.
Figure 9B:
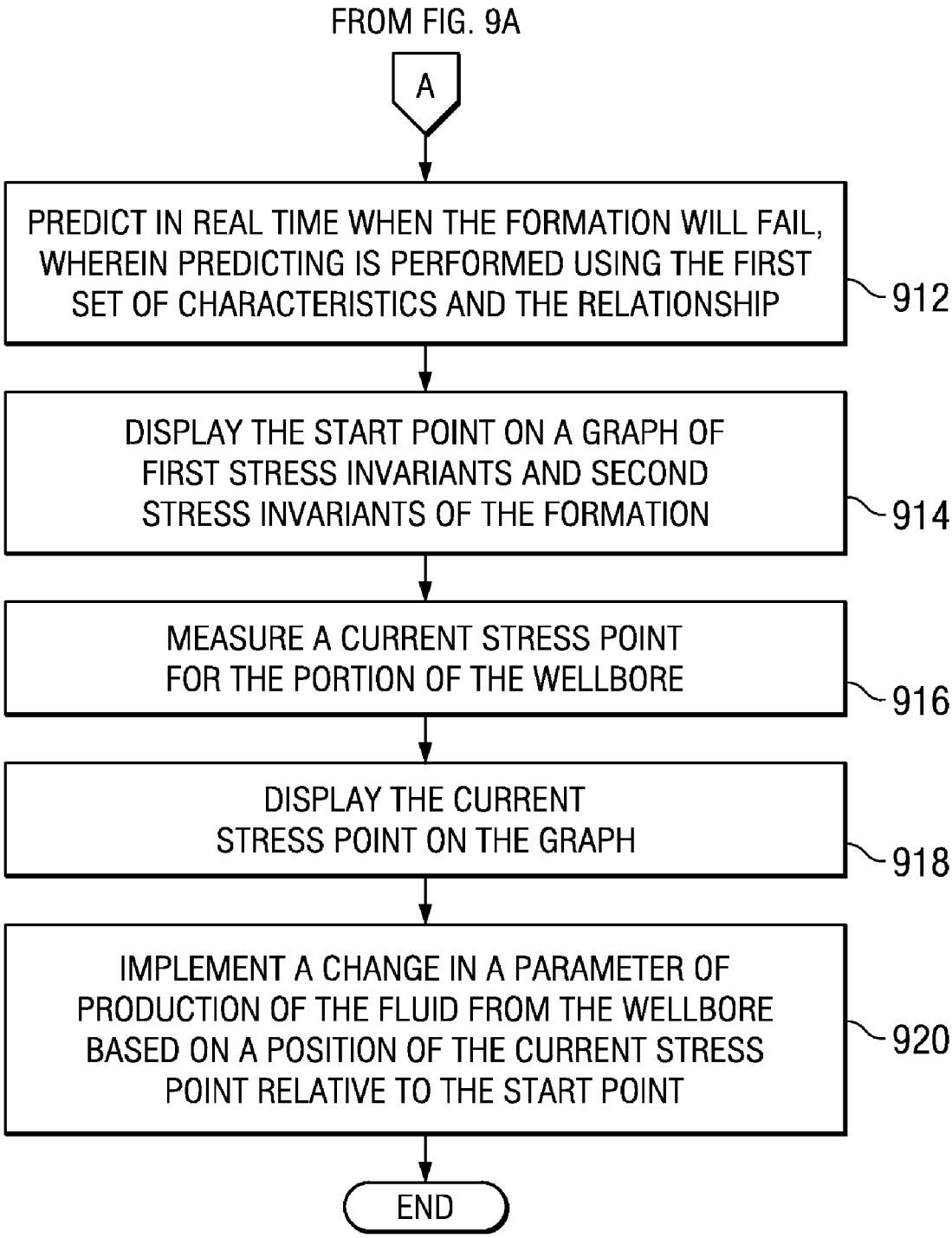

FIGS. 9A and 9B is a flowchart illustrating a process of controlling production of a fluid from a wellbore using the illustrative methods, in accordance with an illustrative embodiment. The process shown in FIGS. 9A and 9B can be implemented in a data processing system, such as data processing system 100 shown in FIG. 1 or data processing system 200 shown in FIG. 2. The process shown in FIGS. 9A and 9B can be implemented with respect to an oil production facility, such as platform 306 shown in FIG. 3. The process shown in FIGS. 9A and 9B can be implemented using one or more processors in one or more data processing systems, possibly connected via a network. A reference to "a processor" with respect to the process of FIGS. 9A and 9B can refer to these one or more processors.

The process begins as the processor determines a first set of characteristics of a formation in the production zone, wherein determining uses a plastic model of the formation, and wherein the first set of characteristics comprises a yield surface, a failure surface, a stress total strain, an elastic strain, and a plastic-strain relationship (step 900). The processor then determines a relationship among a second set of characteristics of the wellbore using an effective stress model, wherein the second set of characteristics comprises a drawdown pressure, a production rate, pore pressure, a temperature and viscosity of a fluid in the wellbore, a temperature of the production zone, a fluid flow pressure in the wellbore, a drag force of fluid flow in the wellbore, and a type of fluid flow in the wellbore (step 902).

The processor determines a critical total strain for the formation using the first set of characteristics and the relationship (step 904). The processor calibrates the critical total strain using a thick wall test performed under in-situ conditions, wherein a calibrated critical total strain is formed (step 906). The processor then causes the calibrated critical total strain to be stored, wherein the calibrated critical total strain comprises the start point (step 908).

The processor can then be used to predict in real time when the formation will yield, wherein predicting is performed using the first set of characteristics and the relationship (step 910). Similarly, and possibly in addition to step 910, the processor can then be used to predict in real time when the formation will fail, wherein predicting is performed using the first set of characteristics and the relationship (step 912). The start point can be displayed on a graph of first stress invariants and second stress invariants of the formation (step 914).

In an illustrative embodiment, the processor can measure a current stress point for the portion of the wellbore (step 916). The processor then displays the current stress point on the graph (step 918). If desirable, the processor can either display a recommendation of, or cause implementation of, a change in a parameter of production of the fluid from the wellbore based on a position of the current stress point relative to the start point (step 920). The process terminates thereafter.

Although the foregoing is provided for purposes of illustrating, explaining and describing certain embodiments of the invention in particular detail, modifications and adaptations to the described methods, systems and other embodiments will be apparent to those skilled in the art and may be made without departing from the scope or spirit of the invention.

What is claimed is:

1. A computer-implemented method for predicting a start point at which sand production will begin at a production zone in a wellbore of a production facility, the computer-implemented method comprising:

determining a first set of characteristics of a formation in the production zone, wherein determining uses a plastic model of the formation, and wherein the first set of characteristics comprises a yield surface, a failure surface, a stress total strain, an elastic strain, and a plastic-strain relationship;

determining a relationship among a second set of characteristics of the wellbore using an effective stress model, wherein the second set of characteristics comprises a drawdown pressure, a production rate, pore pressure, a temperature and a viscosity of a fluid in the wellbore, a temperature of the production zone, a fluid flow pressure in the wellbore, a drag force of fluid flow in the wellbore, and a type of fluid flow in the wellbore;

determining a critical total strain for the formation using the first set of characteristics and the relationship;

calibrating the critical total strain using a thick wall test performed under in-situ conditions, wherein a calibrated critical total strain is formed;

storing the calibrated critical total strain, wherein the calibrated critical total strain comprises the start point;

displaying the start point on a graph of first stress invariants and second stress invariants of the formation;

measuring a current stress point of the formation;

displaying the current stress point on the graph;

monitoring movement of the displayed current stress point relative to the start point in real time; and adjusting a producing wellbore parameter in response to monitoring to prevent the current stress point from reaching the start point.

2. The computer-implemented method of claim 1 further comprising:

predicting in real time when the formation will yield, wherein predicting is performed using the first set of characteristics and the relationship.

3. The computer-implemented method of claim 1 further comprising:

predicting in real time when the formation will fail, wherein predicting is performed using the first set of characteristics and the relationship.

4. The computer-implemented method of claim 1 wherein the first set of characteristics further comprises at least one of a porosity of the formation, wetability characteristics of the formation, a permeability of the formation, an average particle size of a material of the formation, and a distribution of particles in the material of the formation.

5. The computer-implemented method of claim 1 wherein the first set of characteristics comprises at least all three effective stresses in the formation, including an effective overburden in the formation, an effective maximum horizontal stress of the formation, and an effective minimum horizontal stress of the formation.

6. The computer-implemented method of claim 1, wherein the producing wellbore parameter comprises at least one of a bottom hole fluid pressure in the wellbore a fluid flow type in the wellbore, and rate of fluid flow produced from the wellbore.

7. The computer-implemented method of claim 1, further comprising:

making a determination of whether sand mitigation systems should be installed in the wellbore based on a position of the current stress point relative to the start point.

8. The computer-implemented method of claim 1, wherein the current stress point is equal to or greater than the start point, and wherein the computer-implemented method further comprises:

approximating an amount of sand that will be produced from the formation as a result of the production of the fluid from the formation.

9. The computer-implemented method of claim 8 wherein the wellbore comprises a first zone and a second zone, wherein the formation is a part of only one of the first zone and the second zone, and wherein the computer-implemented method further comprises:

determining whether the formation is in the first zone or in the second zone; and responsive to a determination that the formation is in the first zone, shutting down the production of the fluid in the first zone.

10. The computer-implemented method of claim 9 wherein the first zone and the second zone are monitored independently.

11. The computer-implemented method of claim 9 wherein the production of the fluid continues in the second zone.

12. The computer-implemented method of claim 1 further comprising:

implementing a change in a parameter of production of the fluid from the wellbore based on the start point.

13. The computer-implemented method of claim 1 further comprising:

making a determination of whether sand mitigation systems should be installed in the wellbore based on the start point.

* * * * *